United States Patent [19]

Reiner et al.

[11] 4,407,596

[45] Oct. 4, 1983

[54] CASE SHIFT AND LOCK INPUT MECHANISM INCLUDING A SHIFT CONTROL SWITCH

[75] Inventors: Barry C. Reiner, Homer, N.Y.; Robert M. DuRoss, Huntsville, Ala.

[73] Assignee: SCM Corporation, New York, N.Y.

[21] Appl. No.: 268,536

[22] Filed: May 29, 1981

[51] Int. Cl.[3] ..... B41J 25/24

[52] U.S. Cl. ..... 400/253; 400/276; 400/277; 400/440.2; 400/491.2; 400/495.1

[58] Field of Search ..... 400/251, 253, 258, 274, 400/276, 276.2, 277, 436, 437, 440, 440.1, 440.2, 472, 491.2, 495.1; 200/5 B

[56] References Cited

U.S. PATENT DOCUMENTS

| | | | |
|---|---|---|---|
| 550,473 | 11/1895 | Bigelow | 400/276 |
| 1,055,520 | 3/1913 | Cook | 400/276 |
| 3,283,873 | 11/1966 | Robinson | 400/253 |
| 3,288,261 | 11/1966 | Hoiseth et al. | 400/253 |
| 3,565,231 | 2/1971 | Dannatt | 400/251 |
| 3,863,748 | 2/1975 | Trezise | 400/276 |
| 4,071,719 | 1/1978 | Madland | 400/258 X |
| 4,269,521 | 5/1981 | Longrod | 400/472 |
| 4,295,012 | 10/1981 | Keeler et al. | 200/5 B |

*Primary Examiner*—Ernest T. Wright, Jr.

*Attorney, Agent, or Firm*—William E. Mear, III; Ernest F. Weinberger

[57] ABSTRACT

A case shift and lock input mechanism comprising a pair of independently depressable shift keylevers and a depressable shift lock keylever are assembled in a keyboard for actuating a single shift control switch used to condition a printer for printing upper case characters when the switch is actuated. A pivotal bail member is interposed between the switch and each shift keylever for engageably actuating the switch in response to depression of either shift keylever. The shift lock keylever directly actuates the switch when it is depressed to a lock position. A latch device comprising a latch member pivotally mounted on the switch operates to releasably hold the shift lock keylever in the lock position to keep the switch closed for continual typing of upper case characters. The shift lock keylever is released from the lock position through the bail member by subsequent depression of either shift keylever. Each shift keylever actuates the switch independent of the shift lock keylever.

6 Claims, 9 Drawing Figures

CASE SHIFT AND LOCK INPUT MECHANISM INCLUDING A SHIFT CONTROL SWITCH

BACKGROUND OF THE INVENTION (1) Field of the Invention

This invention relates to a case shift mechanism assembled in a keyboard portion of a printer or the like machine. More particularly, the present invention relates to a case shift and lock input mechanism wherein case shift operation is governed by selectively closing a single shift control switch.

(2) Description of the Prior Art

Keyboards of the kind used in conjunction with printers or typewriters commonly employ shift function keys comprising a pair of shift keys and a shift lock key. The three keys are individually selectable by the typist for typing, e.g., one or a few upper case characters by depressing one of the shift keys or a series of upper case characters by depressing the shift lock key which is then held in its depressed position by a locking device.

The prior art discloses many varied and different input mechanisms for accomplishing case shift and lock functioning. These mechanisms must economically combine ease of part fabrication and assembly for low manufacturing expense. This, coupled with high reliability and ease of maintenance at low cost are becoming increasingly difficult to satisfy due to ever increasing labor and material costs. Consequently, use of unduly complex mechanisms requiring close dimensional tolerances and careful adjustments during assembly are impractical.

With the advent of electro-mechanical typewriters, manufacturers have successfully reduced many of the previously complicated linkages found in totally mechanical prior case shift mechanisms by replacing them with simple electronic components, such as switches. An example of an electro-mechanical input combination utilized for shift and shift lock functioning is found in U.S. Pat. No. 4,071,719 granted on Jan. 31, 1978 to Robert C. Madland. This device shows two shift keyswitches, each having a slide member coupled together by a rod. A shift lock keyswitch has its own slide member. The slide member of the lock keyswitch interacts with the slide members of the two shift keyswitches so the slide linkage will not operate except when the shift keyswitch is in the lock mode. Each keyswitch has an associated switch for performing a case shift operation. The disadvantages in this device are directly related to its overall complexity, as for example, to the relatively large number of components needed, including the use of a plurality of expensive electrical switches for shift operation. The phsycial configuration of the keyswitches themselves are complex making them difficult to fabricate and assemble.

Another example of a shift input utilizing an electromechanical combination is disclosed in U.S. Patent No. 3,863,748 granted to Richard Trezise on February 4, 1975. The Trezise patent discloses a shift lock mechanism comprising a spring supported lock key and a latching bellcrank for holding the lock key when it is fully depressed. A reed switch is provided to coact only with a shift key when it is depressed to initiate shift operation. To effectuate shift operation from the lock key, the shift key must also be depressed. To accomplish this, Trezise provides a plate extending from the shift key beneath the lock key for engageably causing the shift key to move with the lock key. A major disadvantage found in this arrangement is that dissimilar key forces resisting key movement, are expierenced by the operator when depressing the shift lock key as compared to depressing the shift key. Depression of the shift key is resisted only by its support spring. Depression of the lock key is resisted by its support spring together with the support spring of the carried shift key. Thus, two different key forces must be overcome by the typist when selwecting between shift and shift lock inputs.

Accordingly, there is a need for a more economical, highly reliable case shift and lock input mechanism. Moreover, an improved shift key mechanism must incorporate a minimum number of parts arranged in a manner to provide substantially uniform key touch, thus, avoiding disadvantages found in the prior art.

SUMMARY OF THE INVENTION

In accordance with the present invention there is provided a simple case shift and lock input mechanism which includes a minimum of components, namely, a pair of shift keylevers, a shift lock keylever and a shift control switch actuatable by any one of the three mentioned keylevers. The shift control switch is utilized in an electric typewriter for emitting an electrical signal to condition the typewriter to perform upper case printing when the switch is actuated into a closed position. The two shift keylevers are structurally identical to minimize manufacturing costs. A pivotal bail member underlies both shift keylevers for actuating the shift control switch when either shift keylever is depressed. The shift lock keylever is operable independently of the two shift keylevers and directly actuates the shift control switch when depressed. A latch device comprising a latch member pivotally mounted on the switch coacts with an ear portion of the lock keylever for engageably holding the lock keylever in a locked position when fully depressed. Release of the lock keylever is accomplished by subsequent depression of one shift keylever. This causes the bail to contact the latch member which, in turn, removes it from locking engagement with the lock keylever.

An object of the present invention is to provide a relatively simple and highly reliable mechanism for enabling an operator to initiate a case shift operation either from a shift key or a shift lock key in a typewriter.

Another object of the present invention is to provide a case shift and lock input mechanism having a pair of shift keys and a lock key wherein the shift keys operate independently of one another and the lock key operates independently of the shift keys with the three keys all having essentially the same key touch.

Another object of the present invention is to provide a case shift and lock input mechanism wherein a single electrical switch is utilized by the three shift input keys.

Other objects and many of the attendant advantages of this invention will be readily appreciated as the same becomes better understood by reference to the following detailed description when considered in connection with the accompanying drawing.

DESCRIPTION OF THE PREFERRED EMBODIMENT

Figure 1:
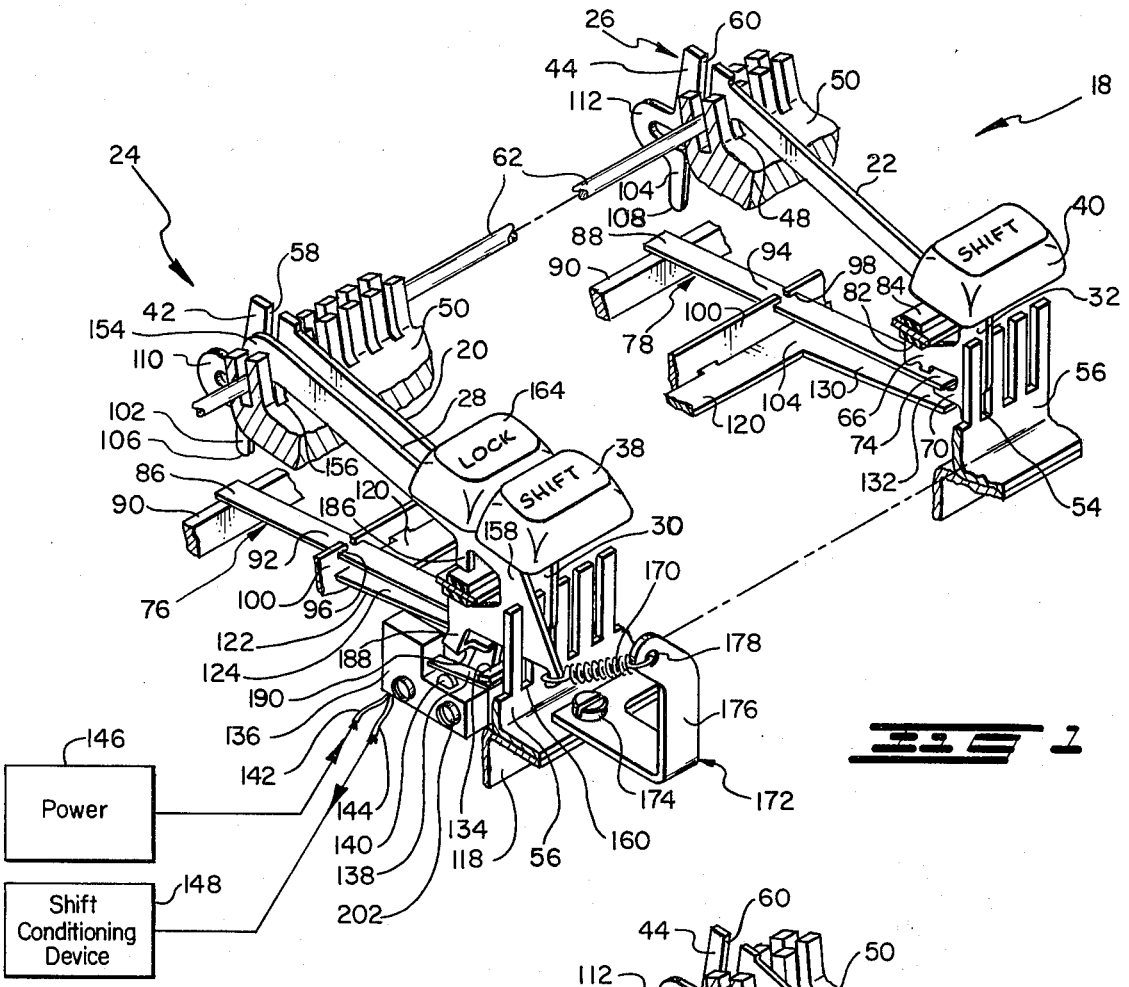
FIG. 1 is a left front perspective view showing the assembled component parts according to the present case shift and lock input mechanism.
Figure 5:
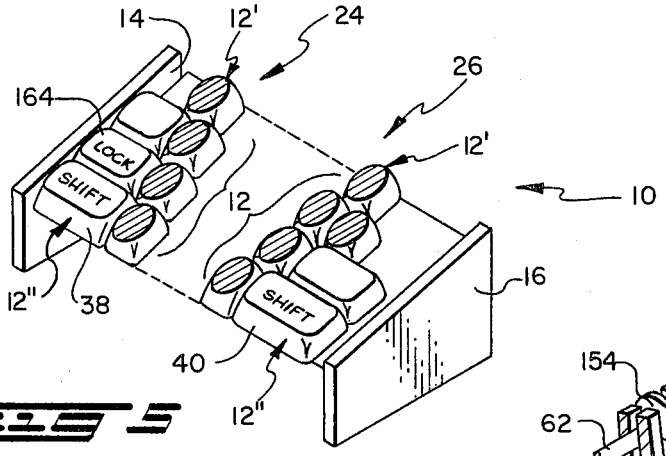
FIG. 5 is a partial right front perspective view of a keyboard showing two shift keys and a shift lock key and their relationship with character keys assembled between side frames of the keyboard.

The invention described hereinafter is utilized in a keyboard 10, such as is shown in FIG. 5, wherein there is arranged generally a plurality of depressable keys 12 mounted between a left and a right side frame 14, 16. Keyboard 10 is preferably of the kind used in conjunction with a typewriter or other similar keyboard input machine. Shaded keys 12' depict alphanumeric key inputs and the larger plane keys 12'' represent various functional keys associated with a particular form of keyboard 10. As is common in typewriter keyboards, alphanumeric keys 12' are assigned a dual function, for example, each one of the keys 12' is capable of causing printing of either an upper or a lower case form of the same letter when depressed. The print form typed depends on the shift mode selected. The two shift modes are interchangeably controlled by the typist through operation of a case shift input mechanism on keyboard 10, such as the one generally denoted by the reference numeral 18 best shown in FIG. 1. The case shift input mechanism 18 built in accordance with the teachings of the present invention comprises a pair of shift keylevers 20, 22 conveniently located at left and right margins 24, 26 of keyboard 10 and a shift lock keylever 28 positioned along the left margin 24 proximate shift keylever 20.

The shift keylever 20, 22 portion of the present invention will now be fully described in connection with FIGS. 2, 3 and 4. This portion of the mechanism 18 is intended to be used by the typist when it is desired to type one or only a few consecutive upper case characters. The two shift keylevers 20, 22 are identically shaped to permit economical fabrication of one common keylever profile. Forwardmost end 30, 32 of the keylevers 20, 22 have a key stem configuration 34, 36 for firmly supporting a finger-engageable shift keybutton 38, 40.

Figure 2:
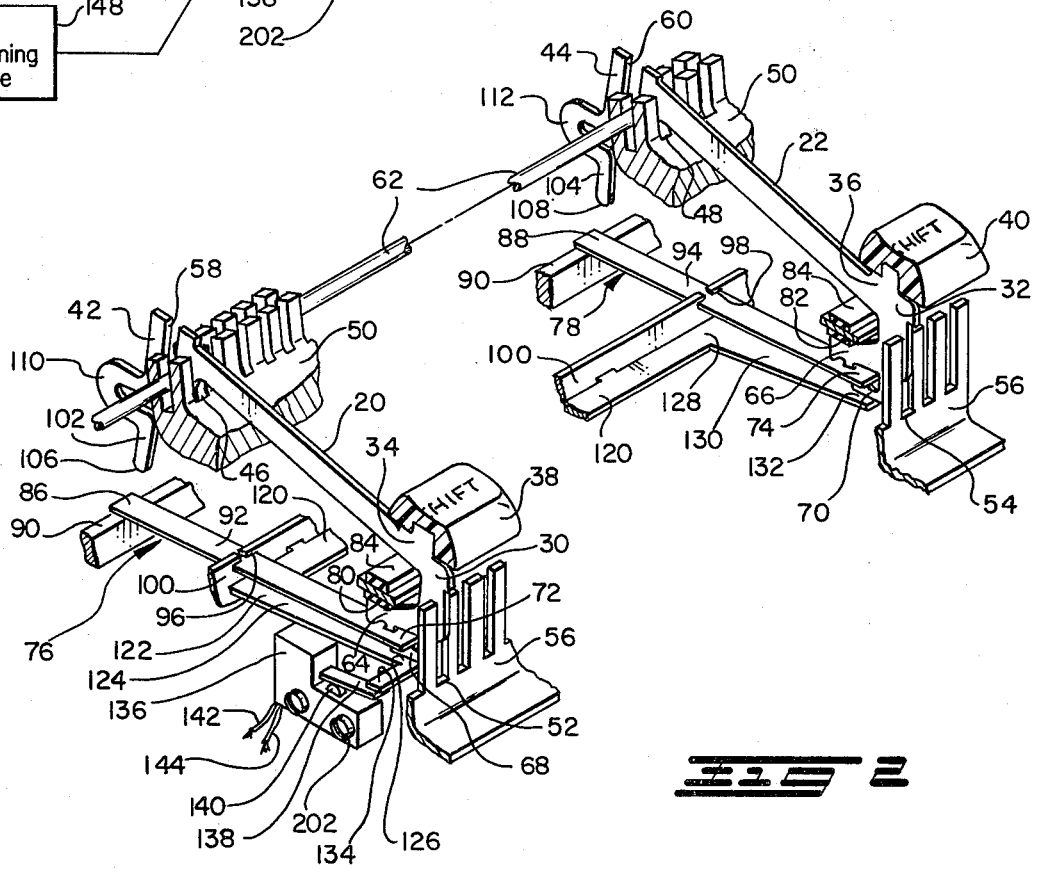
FIG. 2 is a perspective view similar to FIG. 1 showing the shift keylever portion of the present invention with the shift lock portion removed.

As illustrated in FIG. 2, rear portion 42, 44 of shift keylevers 20, 22 extends through a slot 46, 48 of a rear frame member 50 fixed between frames 14, 16 in a manner not shown. Forward end 30, 32 extends through a slot 52, 54 of a front guide member 56 which is also fixed between frames 14, 16. A vertically oriented open-end slot 58, 60 on rear portion 42, 44 of keylevers 20, 22 receives an elongated shaft 62 fixed on rear frame member 50. In this manner, displacement of keylevers 20, 22 is controlled in a substantially vertical path.

Forward end 30, 32 of keylevers 20, 22 includes a rearward extending intermediate arm 64, 66 and a depending lower arm 68, 70 formed to combine and support an end 72, 74 of a resilient keylever support spring 76, 78. A flat upper edge 80, 82 of arms 64, 66 extends beneath a stop member 84. Leaf springs 76, 78 are fabricated from a suitably magnetizable material, such as a steel alloy. A free end 86, 88 of leaf springs 76, 78 is normally held in an unactuated position, as shown in FIG. 3, through magnetic engagement with a stationary elongated permanent magnet 90. An intermediate portion 92, 94 of leaf springs 76, 78 is pivotally supported on a fulcrum structure 96, 98 recessed on a fixed bar 100.

A finger 102, 104 of keylevers 20, 22 extends downwardly from rear portion 42, 44 to terminate at a rounded abutment tip 106, 108 resting above free end 86, 88 of springs 76, 78. A U-shape configuration at 110, 112 integrally connects tips 106, 108 with rear portion 42, 44. The purpose of providing U-shape configuration 110, 112 is to enable bending adjustment thereat for controlling the vertical spaced relation between tip 106, 108 and free end 86, 88 which limits upward travel of the free end 86, 88 upon release of springs 76, 78 from the holding magnet 90 as is shown in FIG. 4.

A downstanding abutment 114 on end 30 of keylever 20 extends from lower arm 68 in a direction toward a shelf 116 formed on a bracket 118 which is fixed on front guide member 56.

An elongated bail member 120 is pivotally supported on bar 100 below fulcrum support recesses 96, 98. One end 122 of bail member 120 has a finger 124 extending directly beneath shift keylever 20. An end portion 126 of finger 124 is situated to abut with lower arm 68 of keylever 20. The other end 128 of bail member 120 has a finger 130 extending directly beneath shift keylever 22. An end portion 132 of finger 130 is situated to abut with lower arm 70 of keylever 22. A side projection 134 on finger 124 extends outwardly from end portion 126 in a direction towards an electrical switch 136 fixedly supported in keyboard 10.

Electrical switch 136 includes an actuator arm 138 resting on a depressable actuator button 140 which is biased upwardly by a spring device within switch 136. Side projection 134 sits upon actuator arm 138 which is urged upward sufficiently to completely support bail member 120 with end portions 126 and 132 in engagement with lower arms 68, 70, respectively. Wires 142, 144 are electrically connected to switch 136. An electrical power source is illustrated by box 146 in FIG. 1. Wire 142 continually carries an electrical current from power source 146 to switch 136. The other wire 144 connects switch 136 with a suitable shift conditioning device 148 in the typewriter. The shift conditioning device 148 is used to control the shift mode of the typewriter as determined by the presence or absence of an electrical signal on wire 144. The electrical signal appears on wire 144 when actuator button 140 is substantially depressed within switch 136 as is shown in FIG. 4. The electrical signal on wire 144 is compatible for use by electronic devices contained in shift conditioning device 148 to cause the typewriter to print in an upper case mode. The typewriter will remain in the upper case mode as long as actuator button 140 is depressed. An absence of the electrical signal on wire 144 conditions the typewriter in a normal (most frequently used) lower case shift mode as illustrated in the arrangement of parts in FIG. 3. Switch 136 is illustrated as a micro-switch, but, may be of any known and readily available type which functions in response to displacement of an actuator member such as button 140.

A case shift operation using either shift keylever 20 or 22 will now be described with reference to FIGS. 3 and 4, wherein only the left shift keylever 20 is illustrated. The configuration of the component parts of the shift keylever 20 portion of the present case shift input mechanism 18 are shown in their rest or normal position in FIG. 3. Upper edge 80 of intermediate arm 64 on keylever 20 is urged into engagement with stop member 84 through the upwardly tensional support applied to keylever 20 from end 72 of leaf spring 76. Free end 86 of leaf spring 76 abuts magnet 90 and is held thereat by the magnetic force of the magnet 90. End portion 126 of finger 124 is urged into contact with lower arm 68 of keylever 20 through the biased support from actuator arm 138 of switch 136. Actuator button 140 of switch 136 when elevated is in the "open" position. Thus, when the shift keylever 20 is undepressed, no electrical signal is present on wire 144 and the typewriter print element is in a lower case shift mode for continuous typing of lower case characters in response to operator selection of any character key 12'.

Figure 3:
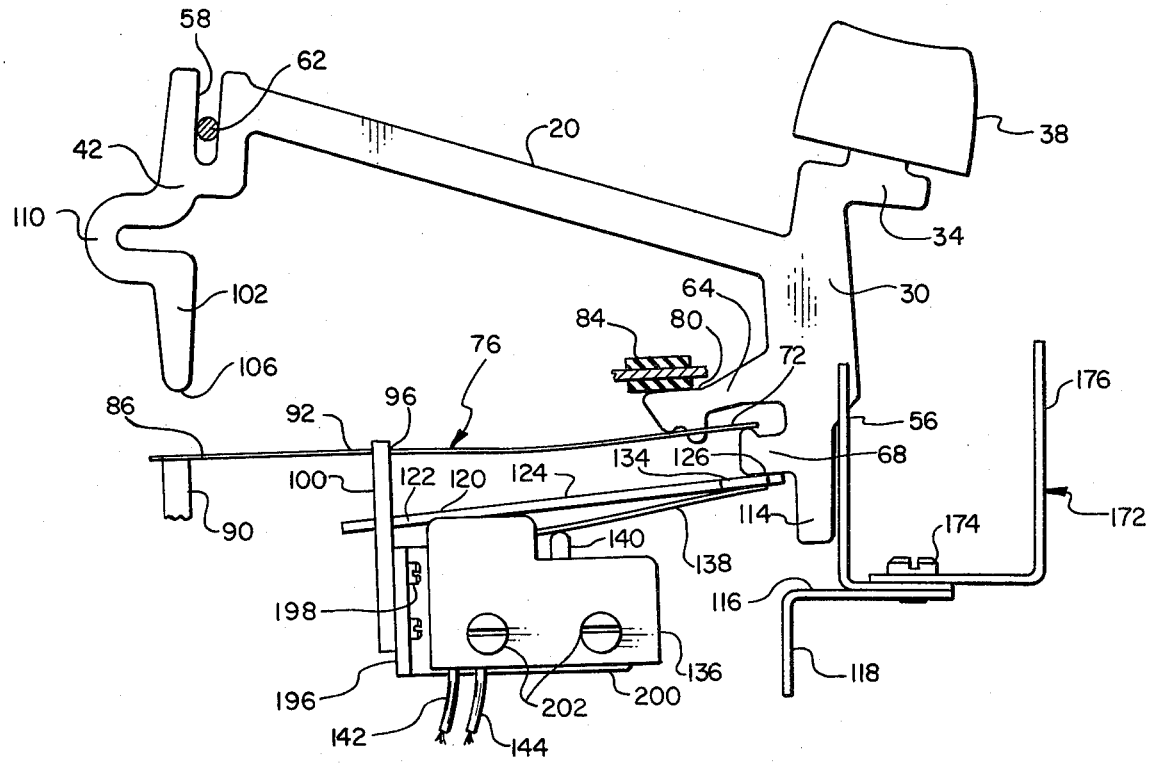
FIG. 3 is a left side elevational view of one shift keylever at rest.
Figure 4:
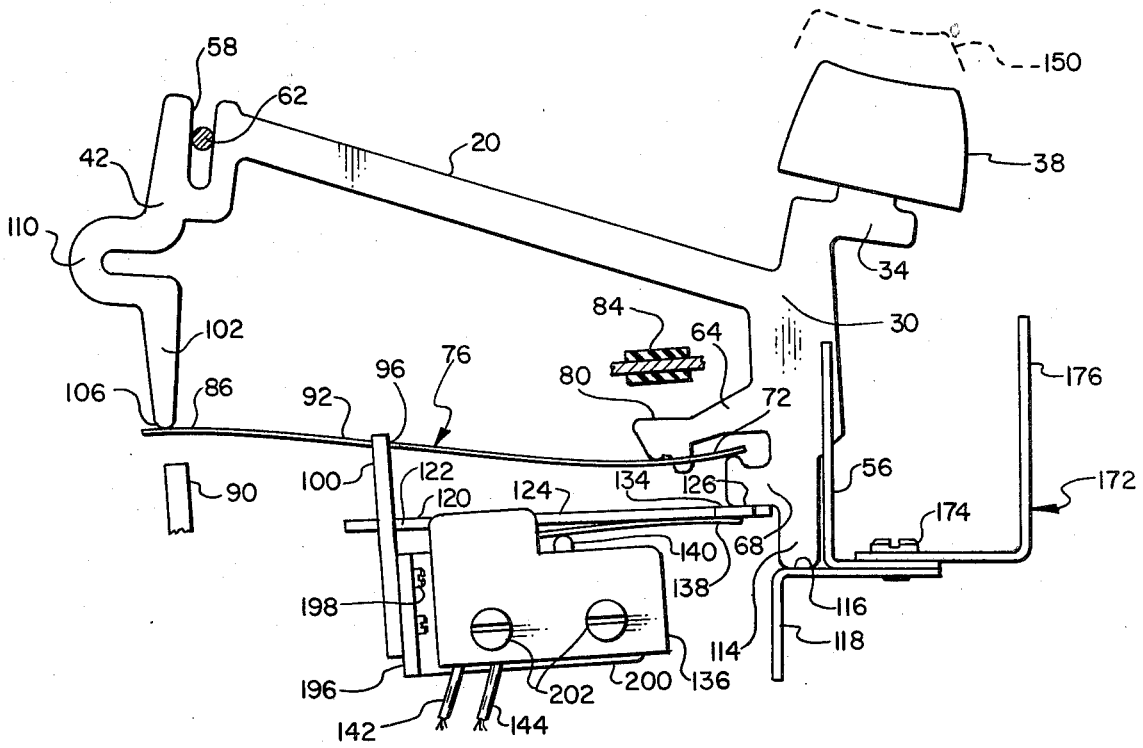
FIG. 4 is a view similar to FIG. 3 with the shift keylever in the depressed position.

In order to type in the upper case position, the operator depresses shift keybutton 38 to displace shift keylever 20 from its rest position as in FIG. 3, to its depressed position as is shown in FIG. 4. The rest position of shift keybutton 38 is indicated in FIG. 4 by a broken line 150. Keylever 20 moves downwardly against the resistance provided by leaf spring 76. Shift keylever 20 is guided in slots 46, 52 for maintaining stability during its vertical displacement. End portion 126 of finger 124 is engageably driven downwardly with the keylever 20 causing bail member 120 to pivot (clockwise) against the biased support of actuator arm 138.

In initially moving keylever 20 from its rest position to its depressed position, end 72 of leaf spring 76 is carried with keylever 20. Free end 86 remains held by magnet 90 causing leaf spring 76 to flex about fulcrum support recess 96. As a result, a force build-up resisting keylever 20 depression occurs within leaf spring 76 tending to move free end 86 away from magnet 90. Just prior to keylever 20 reaching its downstop limit, the force accumulation within leaf spring 76 is sufficiently increased to overcome the hold of magnet 90. Free end 86 then quickly snaps upwardly to contact displaced tip 106 of finger 102 on keylever 20 as shown in FIG. 4. This snap action provides an action known in the art as a "tactile touch" feed-back which is directly felt by the operator through finger engagement with keybutton 38. Tactile feed-back is a desirable feature in key input mechanisms, since it serves to communicate to the operator a sense that a key function has occured. Character keys 12' are also supported by individual leaf springs, such as spring 76 and operate in a similar fashion. In this regard, equal key touch is realized for all keys 12 of keyboard 10.

As is shown in FIG. 4, downward travel of keylever 20 is limited by a downstanding abutment 114 on end 30 of keylever 20 contacting shelf 116 of bracket 118. In the depressed position, actuator arm 138 of switch 136 is bent downwardly by side projection 134 of the pivoted bail member 120. Actuator button 140, in turn, is sufficiently displaced to close switch 136 to thereby provide an electrical signal at wire 144.

Referring once again to FIG. 2, it can be seen that the right shift keylever 22 operates in the same fashion as the above-described keylever 20 for actuating switch 136. The two shift keylevers 20, 22 are independently operable by having each one of them individually supported by a related support leaf spring 76, 78. In this regard, depression of either one keylever 20, 22 will not affect the rest position of the other one not selected. Bail member 120 is pivoted by either one of the keylevers 20, 22. Thus, only one switch 136 is necessary since the switch 136 is actuated through common bail member 120.

When the depressed shift keylever 20 is released by the operator, upward forces at end 72 of flexed leaf spring 76 will restore keylever 20 towards its original rest position. Actuator button 140 is then allowed to lift actuator arm 138 causing bail member 120 to follow with the returning motion of released keylever 20. Switch 136 is then opened by this action and the electrical signal is removed from wire 144.

The shift lock portion of the present invention is best shown in FIGS. 6–9. The purpose of the shift lock feature is to allow the typist two-hand freedom for continually typing in upper case mode without having to maintain the shift keylever (20, 22) in the depressed state. When lock keylever 28 is depressed from the position of FIG. 7 to the position of FIG. 8, a latch device 152 operates to keep it depressed until released by subsequent operation of either of shift keylever 20, 22.

Figure 6:
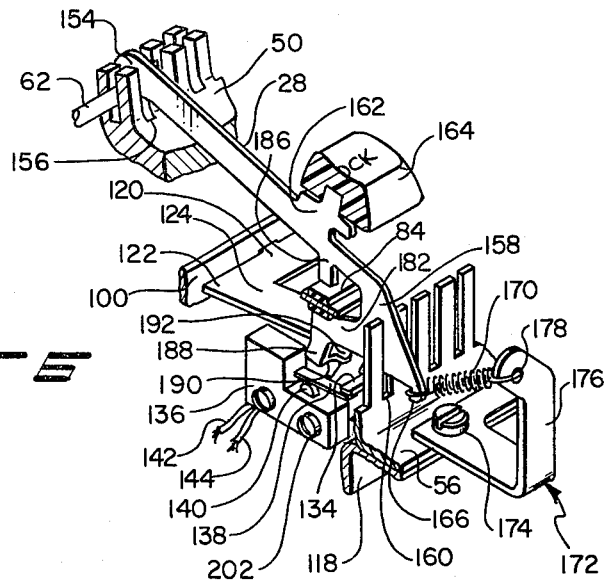
FIG. 6 is a perspective view similar to FIG. 1 showing the shift lock portion of the present invention with the shift keylever portion removed.

To accomplish this, the shift lock keylever 28 includes a rearward end 154 pivotally mounted on shaft 62. In FIG. 6, end 154 is positioned within a slot 156 cut in rear frame member 50. A front end portion 158 of lock keylever 28 extends through a guide slot 160 of front guide member 56. A key stem configuration 162, similar to key stems 34, 36 of shift keylevers 20, 22 is located along lock keylever 28 intermediate end portions 154 and 158. A finger-engageable keybutton 164 is supported on key stem 162 in parallel relation with and just behind the left shift keybutton 38 as is illustrated in the preferred arrangement of keyboard 10 in FIGS. 1 and 5.

Figure 7:
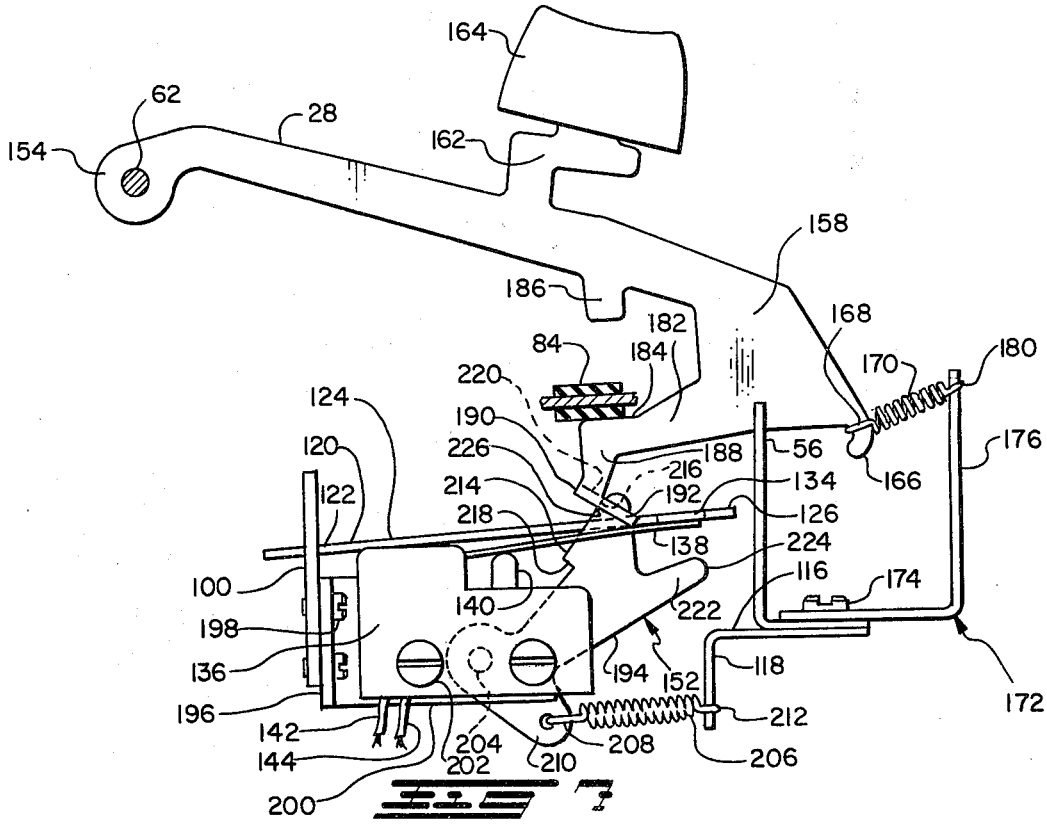
FIG. 7 is a left side elevational view of the shift lock keylever resting in its normal supported position.

A forwardmost tip 166 of lock keylever 28 is hook-shaped for attaching one end 168 of a helical tension spring 170. An L-shaped bracket 172 is fixedly mounted on front guide member 56 by screws 174. An upstanding arm 176 of bracket 172 includes an aperture 178 for attaching the other end 180 of spring 170. An arm 182 extends rearwardly from front end portion 158 of lock keylever 28. An upper flat edge 184 of arm 182 is located beneath stop member 84 and is normally urged into engagement therewith by spring 170 as is shown in FIG. 7. The biased support of spring 170 is substantially equal to the support supplied by leaf springs 76 and 78 on shift keylevers 20, 22, thus, maintaining equal key touch for all keys 12. A downstanding projection 186 located on lock keylever 28 for abutment with stop member 84 limits downward displacement of lock keylever 28.

Lowermost portion 188 of lock keylever 28 includes an ear 190 formed inwardly in a direction towards shift keylever 20. Ear 190 overlaps and extends beyond actuator arm 138 of electrical switch 136. A finger 192 projects forwardly from ear 190 to serve as a guide for maintaining a working relationship between lock keylever 28 and a latch member 194 of latch device 152.

Right-angle bracket 196 is rigidly secured by screws 198 on frame member 100. Arm 200 of bracket 196 extends forwardly for rigid support of switch 136 by screws 202.

Figure 8:
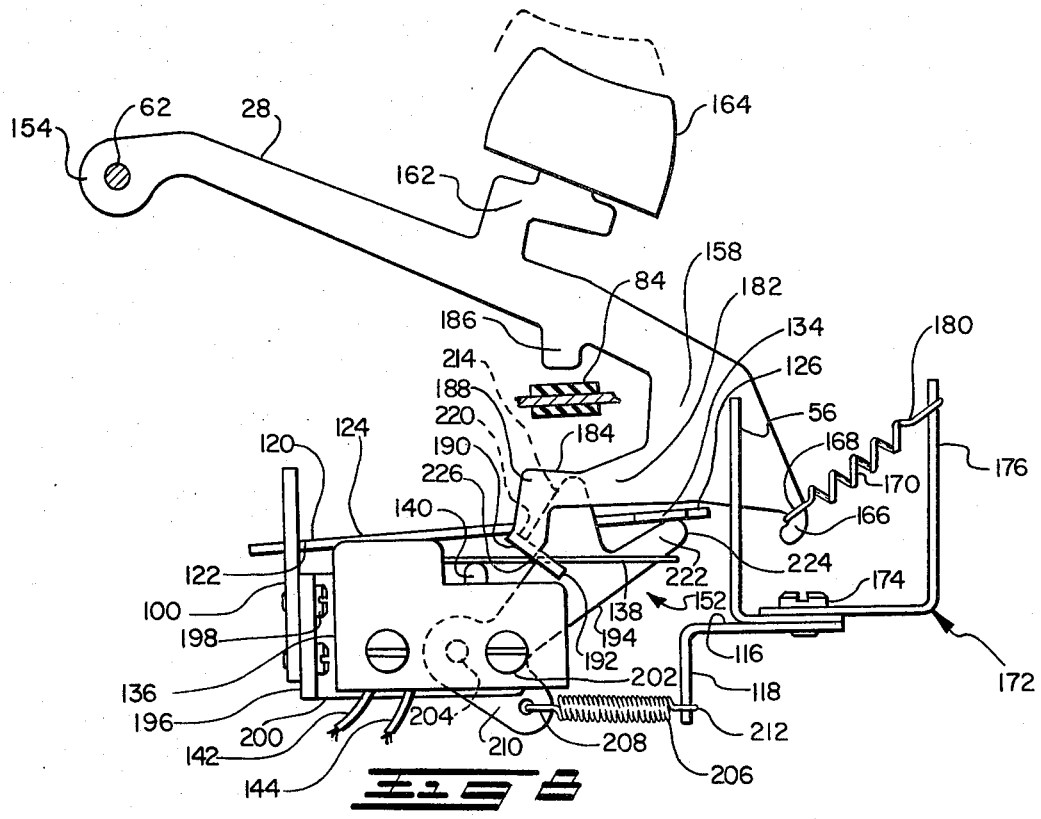
FIG. 8 is a view similar to FIG. 7 with the shift lock keylever in the locked position.
Figure 9:
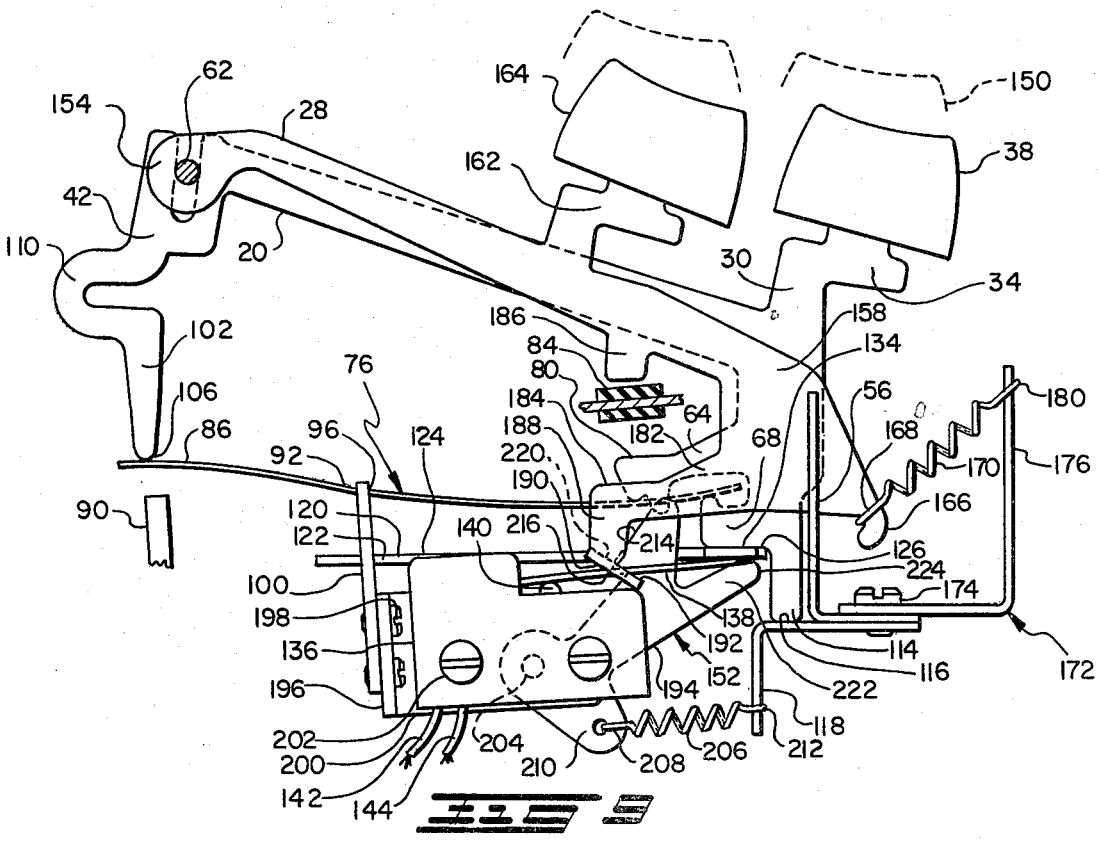
FIG. 9 is a view similar to FIG. 8 showing one shift keylever near its depressed position releasing the shift lock keylever from the lock position.

Latch member 194 of latch device 152 is pivotally supported on arm 200 by pivot stud illustrated by dashed circle 204 in FIGS. 7–9. A spring 206 has one end 208 hooked on a lower arm 210 of latch member 194 and itsothwer end 212 is connected on downstop bracket 118 for urging latch member 194 in a counterclockwise direction towards ear 190 of lock keylever 28 as is shown in FIG. 7. A rearwardly facing edge surface 214 of latch member 194 is caused to engage with a front edge 216 of ear 190 under the urging of spring 206. Shelf 218 is located along edge surface 214 of latch member 194 for catch connection with a top surface 220 of ear 190 when lock keylever 28 is depressed into a lock position as is discussed below with reference to FIG. 8. An upper arm 222 of latch member 194 terminates at a rounded tip 224 which is aligned just below side projection 134 of bail member 120.

A case shift operation using shift lock keylever 28 to lock the typewriter in the upper case mode will now be discussed with reference being made to FIGS. 7–9. The configuration of parts comprising the shift lock function of the present invention are shown in their normal positions in FIG. 7 with shift lock keylever 28 in its supported position. In this position, edge 184 of arm 182 of lock keylever 28 is engaged with stop member 84 by spring 170. Actuator button 140 of switch 136 is in its elevated "open" position supporting actuator arm 138. Front edge 216 of ear 190 of lock keylever 28 is engaged with edge 214 of latch member 194 at a location spaced above shelf 218.

When the shift is to be locked in the upper case mode, the operator presses downwardly on lock keybutton 164 which causes lock keylever 28 to pivot clockwise about shaft 62 against the pull of spring 170. A lowermost corner 226 formed along front edge 182 of ear 190 comes into contact with actuator arm 138 after initial depression of lock keylever 28. Further downward movement of lock keylever 28 flexes actuator arm 138 downwardly causing it to depress actuator button 140 towards actuation of switch 136. Since side projection 134 of finger 124 merely weighs upon actuator arm 138, bail member 120 falls with actuator arm 138 as it is flexed. Shift keylevers 20, 22 remain in their rest position through their biased support from leaf springs 76, 78 when bail member 120 moves away from engagement with shift keylevers 20, 22. Front edge 216 of ear 190 engageably slides along edge surface 214 towards shelf 218 of latch member 194. Edge surface 214 of latch member 194 is dimensionally constructed so as to form an arc about pivot shaft 62. Consequently, latch member 194 remains relatively stationary when ear 190 slides along edge surface 214.

Lock keylever 28 is depressable slightly beyond the locking position of FIG. 8. The downstop limit of lock keylever 28 is reached when downstanding projection 186 abuts stop member 84. At the downstop limit, formed ear 190 of lock keylever 28 is located below shelf 218 so as to permit latch member 194 to pivot rearwardly in a counterclockwise direction under the force supplied by spring 206. As shelf 218 moves towards its latching relation with ear 190, tip 224 of pivoting latch member 194 comes into contact with side projection 134 of bail member 120. It should be noted, the tensional force from spring 206 is fully capable of pivoting latch member 194 while also lifting bail member 120 towards shift keylevers 20, 22. Latch member 194 comes to rest in contact with front edge 216 of ear 190 with shelf 218 located just above top surface 220. Upon releasing finger pressure from the lock keybutton 164, spring 170 urges lock keylever 28 slightly upward until top surface 220 of ear 190 engages shelf 218 of latch member 194 as is shown in FIG. 8. Lock keylever 28 is now in the lock position. In this position, actuator button 140 of switch 136 is sufficiently depressed to actuate switch 136 for sending an electrical signal along wire 144 to condition the typewriter in the upper case shift mode. While lock keylever 28 remains held in the lock position, switch 136 is continuously energized to keep the typewriter in the upper case mode.

To release lock keylever 28 from the lock position of FIG. 8, the operator selectively depresses one shift keylever 20 or 22. In depressing, e.g., shift keylever 20 in FIG. 9, end portion 126 of finger 124 is engaged by lower arm 68 of shift keylever 20 causing bail member 120 to pivot downwardly. Side projection 134 then comes into contact with tip 224 of latch member 194. Further movement of shift keylever 20 pivots latch member 194 clockwise against the pull of spring 206. This motion removes shelf 218 from engagement with top surface 220 thereby releasing its hold on latch member 194 as is shown in FIG. 9. Return spring 206 is then allowed to restore lock keylever 28 towards its normal support position. The depressed shift keylever 20 is returned to rest by leaf spring 76 as previously described. Actuator arm 138 follows the return motion of shift keylever 20 by being urged upwardly from actuator button 140. When shift keylever 20 reaches its rest position, actuator button 140 is restored in its elevated "open" position which removes the electrical signal from wire 144, whereupon the typewriter is conditioned once again in the lower case mode. In a similar fashion as described above, the lock keylever 28 is releasable from the lock position (FIG. 8) through pivot action of bail member 120 by depression of the other shift keylever 22.

From the foregoing, the present case shift input mechanism 18 contains few component parts, namely, identical shift keylevers 20, 22, lock keylever 28, bail member 120, switch 136 and latch member 194. Keylevers 20, 22 and 28 are individually operable in the manner described for actuating a single shift control switch 136. Thus, it is clear that an embodiment made in accordance with the present invention is simple and inexpensive to manufacture, easily assembled, reliable and requires relatively little maintenance. Another advantageous feature found in mechanism 18 is the substantially equal key touch among keylevers 20, 22 and lock keylever 28 and when compared with other keys 12 comprising keyboard 10. Thus, dissimilar key touch forces found in prior shift and shift lock keys are avoided.

It should be understood that the foregoing disclosure relates to only a preferred embodiment of the invention and that numerous modifications or alterations may be made therein without departing from the spirit and the scope of the invention as set forth in the appended claims.

What is claimed is:

1. A case shift and lock input mechanism assembled in a keyboard of a printer capable of printing lower case and upper case characters, the keyboard having a support frame, the improved mechanism comprising:

a pair of spaced apart shift keylevers mounted on the support frame for movement between a normal rest position and a depressed position independently of each other;

a lock keylever mounted on the support frame for movement between a supported position and a locked position independently of said pair of shift keylevers;

a single shift control switch in the mechanism fixed on the support frame and operable between a normal de-energized position for conditioning the printer to print lower case characters and an actuated energized position for producing an electrical signal utilized for conditioning the printer to print upper case characters;

an abutment on said lock keylever for engageably actuating said shift control switch in response to said lock keylever being moved from said supported position to said locked position; and a single member associated with said pair of shift keylevers and operable for mechanically actuating said shift control switch in response to either one of said pair of shift keylevers being moved from said rest position to said depressed position.

2. The case shift and lock input mechanism according to claim 1 wherein said shift control switch has an actuator arm and said single member has a first end portion operatively engageable by one of said pair of shift keylevers, a second end portion operatively engageable by the other one of said pair of shift keylevers and one of said first and second end portions being operable for engaging said actuator arm.

3. The case shift and lock input mechanism according to claim 2 wherein said single member is pivotally mounted on the support frame for movement by either one of said pair of shift keylevers between a first position corresponding to printing of lower case characters and a second position corresponding to printing of upper case characters.

4. The case shift and lock input mechanism according to claim 3 wherein said single member is an elongated bail.

5. The case shift and lock input mechanism according to claim 4 wherein said first and second end portions comprise a finger at each spaced end of said bail and a projection extending from one of said fingers being aligned to contact said actuator arm of said shift control switch.

6. The case shift and lock input mechanism according to claim 1 wherein said abutment is an ear carried by said lock keylever.

* * * * *